US006893251B2

(12) United States Patent
Stephens

(10) Patent No.: US 6,893,251 B2
(45) Date of Patent: May 17, 2005

(54) BURNER DESIGN FOR REDUCED $NO_X$ EMISSIONS

(75) Inventor: George Stephens, Humble, TX (US)

(73) Assignee: Exxon Mobil Chemical Patents Inc., Houston, TX (US)

( * ) Notice: Subject to any disclaimer, the term of this patent is extended or adjusted under 35 U.S.C. 154(b) by 15 days.

(21) Appl. No.: 10/388,979

(22) Filed: Mar. 14, 2003

(65) Prior Publication Data

US 2003/0175638 A1 Sep. 18, 2003

Related U.S. Application Data

(60) Provisional application No. 60/365,224, filed on Mar. 16, 2002.

(51) Int. Cl.[7] ..... F23M 3/00
(52) U.S. Cl. ..... 431/9; 431/5; 126/91 A
(58) Field of Search ..... 431/9, 5, 115, 431/215; 126/91 A

(56) References Cited

U.S. PATENT DOCUMENTS

| | | | |
|---|---|---|---|
| 2,368,370 | A | 1/1945 | Maxon |
| 2,813,578 | A | 11/1957 | Ferguson |
| 2,918,117 | A | 12/1959 | Griffin |
| 2,983,312 | A | 5/1961 | Finley et al. |

FOREIGN PATENT DOCUMENTS

| | | |
|---|---|---|
| CA | 1169753 | 6/1984 |
| DE | 2944153 | 5/1981 |
| DE | 3232421 | 3/1984 |
| DE | 3818265 | 11/1989 |
| EP | 0099828 | 6/1988 |
| EP | 0 347 956 | 12/1989 |
| EP | 0 374 423 | 6/1990 |
| EP | 0 408 171 A1 | 1/1991 |
| EP | 0 507 233 | 10/1992 |
| EP | 0 620 402 A1 | 10/1994 |
| EP | 0 674 135 B2 | 9/1995 |
| EP | 0 751 343 | 1/1997 |
| EP | 0486169 | 1/1998 |
| EP | 1096202 | 2/2001 |
| EP | 1 211 458 | 6/2002 |
| FR | 2629900 | 10/1988 |
| SU | 374488 | 3/1973 |

OTHER PUBLICATIONS

Chemical Engineering Progress, vol. 43, 1947, "The Design of Jet Pumps" by A. Edgar Kroll, pp. 21–24, vol. 1, No. 2.
Straitz III, John F., et al., "Combat NOx With Better Burner Design," *Chemical Engineering*, Nov. 1994, pp. EE–4—EE–8.

(Continued)

*Primary Examiner*—Alfred Basichas
(74) *Attorney, Agent, or Firm*—Lucinda Lomes; Linda A. Kubena

(57) ABSTRACT

A staged-air burner for use in furnaces such as in steam cracking. The burner includes a burner tube including (i) a downstream end, (ii) an upstream end for receiving fuel and air, flue gas or mixtures thereof from a primary air chamber, and (iii) a burner tip mounted on the downstream end of said burner tube and directed to the first flame opening in the furnace, so that combustion of the fuel takes place downstream of said burner tip; a secondary air chamber for supplying a second portion of combustion air, said secondary air chamber in fluid communication with at least one air port; and a wall peripherally surrounding said burner tip to provide a barrier between a base of a flame at said burner tip and said at least one air port.

27 Claims, 6 Drawing Sheets

U.S. PATENT DOCUMENTS 3,880,570 A 4/1975 Marshall
4,004,875 A 1/1977 Zink et al.
4,089,629 A 5/1978 Baumgartner et al.
4,130,388 A 12/1978 Flanagan
4,230,445 A 10/1980 Janssen
4,257,763 A 3/1981 Reed
4,575,332 A 3/1986 Oppenberg et al.
4,629,413 A 12/1986 Michelson et al.
4,708,638 A 11/1987 Brazier et al.
4,739,713 A 4/1988 Vier et al.
4,748,919 A 6/1988 Campobenedetto et al.
4,815,966 A 3/1989 Janssen
4,828,483 A 5/1989 Finke
4,963,089 A 10/1990 Spielman
4,995,807 A 2/1991 Rampley et al.
5,044,931 A 9/1991 Van Eerden et al.
5,073,105 A 12/1991 Martin et al.
5,092,761 A 3/1992 Dinicolantonio
5,098,282 A 3/1992 Schwartz et al.
5,135,387 A 8/1992 Martin et al.
5,152,463 A 10/1992 Mao et al.
5,154,596 A 10/1992 Schwartz et al.
5,195,884 A 3/1993 Schwartz et al.
5,201,650 A 4/1993 Johnson
5,224,851 A 7/1993 Johnson
5,238,395 A 8/1993 Schwartz et al.
5,254,325 A * 10/1993 Yamasaki et al. ..... 423/450
5,263,849 A 11/1993 Irwin et al.
5,269,679 A 12/1993 Syska et al.
5,275,554 A 1/1994 Faulkner
5,284,438 A 2/1994 McGill et al.
5,299,930 A 4/1994 Weidman
5,316,469 A 5/1994 Martin et al.
5,326,254 A 7/1994 Munk
5,344,307 A 9/1994 Schwartz et al.
5,350,293 A 9/1994 Khinkis et al.
5,370,526 A 12/1994 Buschulte et al.
5,407,345 A 4/1995 Robertson et al.
5,413,477 A 5/1995 Moreland
5,470,224 A 11/1995 Bortz
5,472,341 A 12/1995 Meeks
5,542,839 A 8/1996 Kelly
5,562,438 A 10/1996 Gordon et al.
5,584,684 A 12/1996 Dobbeling et al.
5,603,906 A 2/1997 Lang et al.
5,611,682 A 3/1997 Slavejkov et al.
5,624,253 A 4/1997 Sulzhik et al.
5,685,707 A 11/1997 Ramsdell et al.
5,688,115 A * 11/1997 Johnson ..... 431/9
5,807,094 A 9/1998 Sarv
5,813,846 A * 9/1998 Newby et al. ..... 431/9
5,980,243 A 11/1999 Surbey et al.
5,984,665 A 11/1999 Loftus et al.
5,987,875 A 11/1999 Hilburn et al.
5,993,193 A 11/1999 Loftus et al.
6,007,325 A 12/1999 Loftus et al.
6,056,538 A 5/2000 Büchner et al.
6,332,408 B2 12/2001 Howlett et al.
6,347,935 B1 2/2002 Schindler et al.
6,383,462 B1 * 5/2002 Lang ..... 423/235
6,616,442 B2 9/2003 Venizelos et al.

OTHER PUBLICATIONS

Vahdati, M. M., et al., "Design And Development of A Low NOx Coanda Ejector Burner," *Journal of the Institute of Energy*, Mar. 2000, vol. 73, pp. 12–17.
Bussman, Wes, et al., "Low NOx Burner Technology for Ethylene Cracking Furnaces," presented at the *2001 AIChE Spring National Meeting, 13th Annual Ethylene Producers Conference*, Houston, TX, Apr. 25, 2001, pp. 1–23.
Seebold, James G., "Reduce Heater NOx in the Burner," *Hydrocarbon Processing*, Nov. 1982, pp. 183–186.
"West Germany's Caloric Develops a Low–NOx Recycling Fuel Burner," *Chemical Engineering*, Oct. 4, 1982, p. 17.
Abstract of EP 0 507 233 published on Oct. 7, 1992, entitled "Burner for Liquid Fuels".

* cited by examiner

110

160
122
114
120
118
119
176
132
112
116
111
124
126

BURNER DESIGN FOR REDUCED $NO_X$ EMISSIONS

RELATED APPLICATIONS

This patent application claims priority from Provisional Application Ser. No. 60/365,224, filed on Mar. 16, 2002, the contents of which are hereby incorporated by reference.

FIELD OF THE INVENTION

This invention relates to an improvement in a burner such as those employed in high temperature furnaces in the steam cracking of hydrocarbons. More particularly, it relates to a burner employing a separation wall to prevent higher concentrations of oxygen from entering the base of the burner flame.

BACKGROUND OF THE INVENTION

As a result of the interest in recent years to reduce the emission of pollutants from burners used in large industrial furnaces, burner design has undergone substantial change. In the past, improvements in burner design were aimed primarily at improving heat distribution. Increasingly stringent environmental regulations have shifted the focus of burner design to the minimization of regulated pollutants.

Oxides of nitrogen ($NO_x$) are formed in air at high temperatures. These compounds include, but are not limited to nitrogen oxide and nitrogen dioxide. Reduction of $NO_x$ emissions is a desired goal to decrease air pollution and meet government regulations. In recent years, a wide variety of mobile and stationary sources of $NO_x$ emissions have come under increased scrutiny and regulation.

A strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763, which patent is incorporated herein by reference. In addition, many raw gas burners produce luminous flames.

Premix burners mix some or all of the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are nonluminous, permitting tube metal temperatures to be readily monitored. Therefore, a premix burner is the burner of choice for such furnaces. Premix burners can also be designed for special heat distribution profiles or flame shapes required in other types of furnaces.

In gas fired industrial furnaces, $NO_x$ is formed by the oxidation of nitrogen drawn into the burner with the combustion air stream. The formation of $NO_x$ is widely believed to occur primarily in regions of the flame where there exist both high temperatures and an abundance of oxygen. Since ethylene furnaces are amongst the highest temperature furnaces used in the hydrocarbon processing industry, the natural tendency of burners in these furnaces is to produce high levels of $NO_x$ emissions.

One technique for reducing $NO_x$ that has become widely accepted in industry is known as staging. With staging, the primary flame zone is deficient in either air (fuel rich) or fuel (fuel lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Staging results in reducing peak temperatures in the primary flame zone and has been found to alter combustion speed in a way that reduces $NO_x$. Since $NO_x$ formation is exponentially dependent on gas temperature, even small reductions in peak flame temperature dramatically reduce $NO_x$ emissions. However this must be balanced with the fact that radiant heat transfer decreases with reduced flame temperature, while CO emissions, an indication of incomplete combustion, may actually increase as well.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air are more remotely associated with the fuel. The upper limit of flammability refers to the mixture containing the maximum fuel concentration (fuel-rich) through which a flame can propagate.

Thus, one set of techniques achieves lower flame temperatures by using staged-air or staged-fuel burners to lower flame temperatures by carrying out the initial combustion at far from stoichiometric conditions (either fuel-rich or air-rich) and adding the remaining air or fuel only after the flame has radiated some heat away to the fluid being heated in the furnace.

Another set of techniques achieves lower flame temperatures by diluting the fuel-air mixture with a diluent. Flue-gas (the products of the combustion reaction) or steam are commonly used diluents. Such burners are classified as FGR (flue-gas-recirculation) or steam-injected, respectively.

U.S. Pat. No. 5,092,761 discloses a method and apparatus for reducing $NO_x$ emissions from premix burners by recirculating flue gas. Flue gas is drawn from the furnace through a pipe or pipes by the aspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The contents of U.S. Pat. No. 5,092,761 are incorporated herein by reference.

Analysis of burners of the type described in U.S. Pat. No. 5,092,761 has indicated the flue-gas-recirculation (FGR) ratio is generally in the range 5–10% where FGR ratio is defined as:

FGR ratio (%)=100[G/(F+A)]

where G=Flue-gas drawn into venturi, (lb)

F=Fuel combusted in burner, (lb), and

A=Air drawn into burner, (lb).

The ability of these burners to generate higher FGR ratios is limited by the inspirating capacity of the gas spud/venturi combination. Further closing of the primary air dampers will produce lower pressures in the primary air chamber and thus enable increased FGR ratios. However, when the ratio of FGR is increased, the flame becomes more susceptible to entrainment into the FGR duct, which raises combustion temperature, which, in turn raises $NO_x$ and may cause damage to metal parts.

Therefore, what is needed is a burner for the combustion of fuel wherein the amount of FGR can be increased without the problems associated with flame entrainment into the FGR duct, yielding further reductions in $NO_x$ emissions.

SUMMARY OF THE INVENTION

The present invention is directed to a staged-air burner for use in furnaces such as in steam cracking. The burner includes a burner tube including (i) a downstream end, (ii) an upstream end for receiving fuel and air, flue gas or mixtures thereof from a primary air chamber, and (iii) a burner tip mounted on the downstream end of said burner tube and directed to the first flame opening in the furnace, so that combustion of the fuel takes place downstream of said burner tip; a secondary air chamber for supplying a second portion of combustion air, said secondary air chamber in fluid communication with at least one air port; and a wall peripherally surrounding said burner tip to provide a substantial barrier between a base of a flame downstream of said burner tip and said at least one air port.

Also provided is a method for use in a staged-air burner for the combustion of fuel, the burner being located adjacent a first opening in a furnace and including a primary chamber for supplying a first portion of combustion air, a burner tube including a downstream end, an upstream end for receiving fuel and air, flue gas and mixtures thereof, a burner tip mounted on the downstream end of the burner tube adjacent the first opening in the furnace, so that combustion of the fuel takes place downstream of the burner tip and a secondary air chamber for supplying a second portion of combustion air, the secondary air chamber in fluid communication with at least one air port; the method comprising installing a wall peripherally surrounding the burner tip mounted on the upstream end of the burner tube to provide a substantial barrier between a base of a flame downstream of the burner tip and the at least one air port.

An object of the present invention is to provide, in a burner, a wall between the burner flame and an oxygen recirculation zone to reduce $NO_x$ emissions.

These and other objects and features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF SPECIFIC EMBODIMENTS

Figure 1:
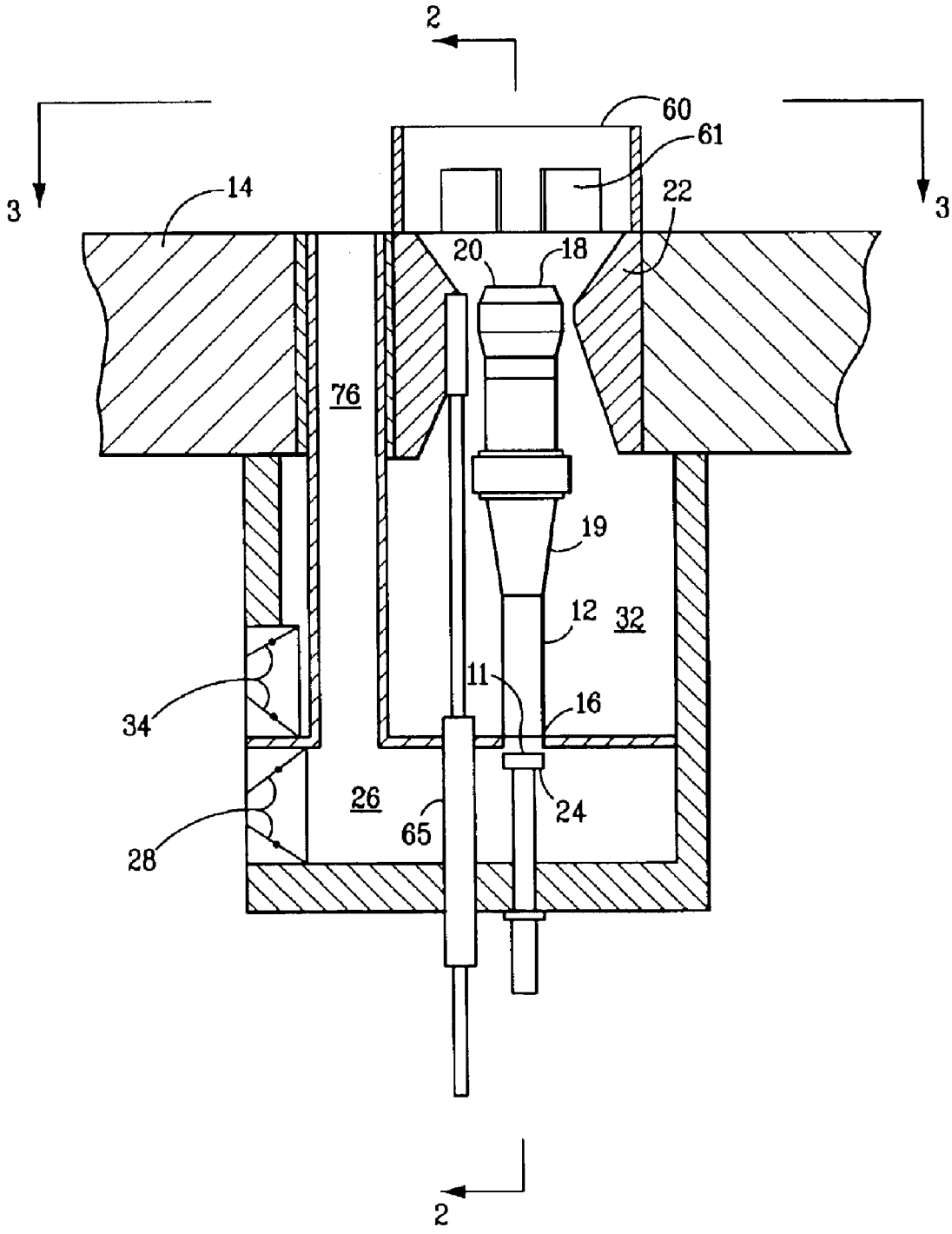
FIG. 1 illustrates an elevation partly in section of an embodiment of the burner with a separation wall in accordance with the present invention.
Figure 2:
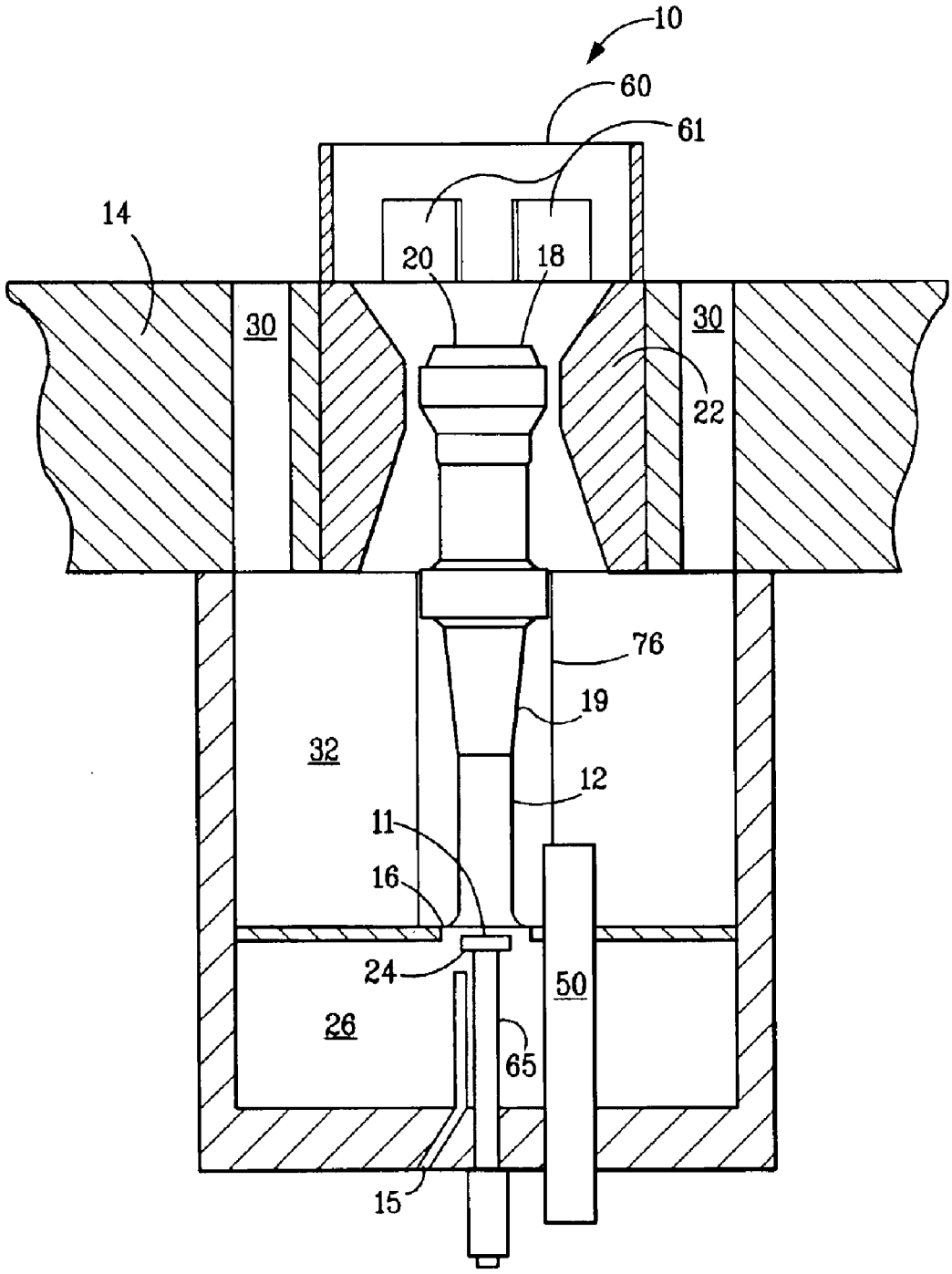
FIG. 2 is an elevation partly in section taken along line 2—2 of FIG. 1.
Figure 3:
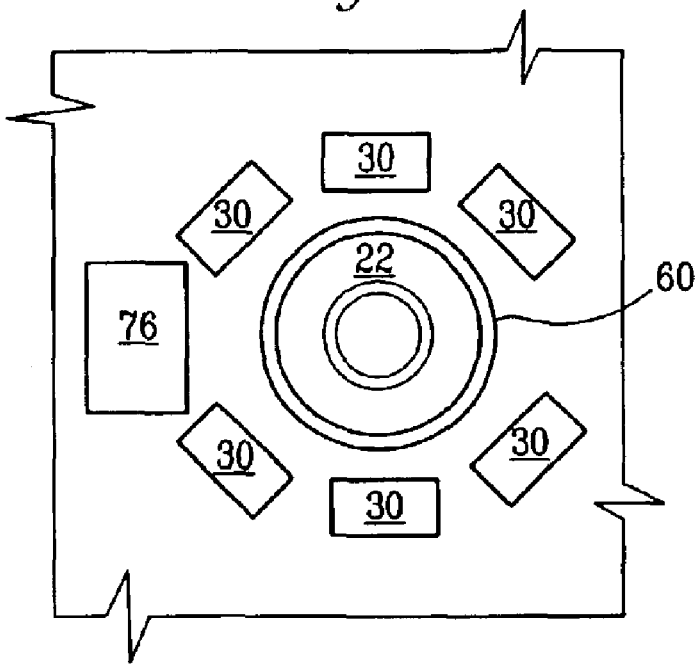
FIG. 3 is a plan view taken along line 3—3 of FIG. 1.
Figure 4:
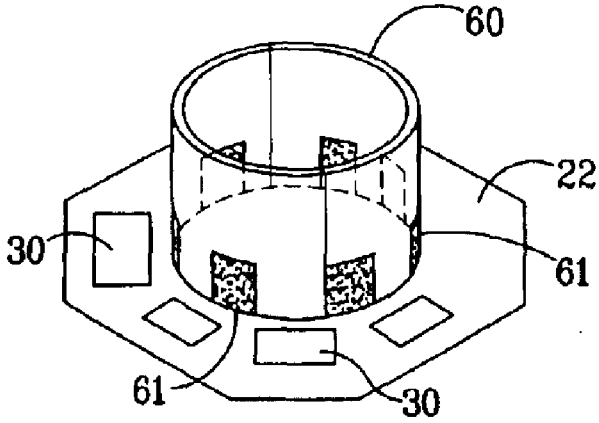
FIG. 4 is a perspective view of a separation wall in accordance with the instant invention.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring to FIGS. 1–4, a burner 10 includes a freestanding burner tube 12 located in a well in a furnace floor 14. The burner tube 12 includes an upstream end 16, a downstream end 18 and a venturi portion 19. A burner tip 20 is located at the downstream end 18 and is surrounded by an annular tile 22. A fuel orifice 11, which may be located in gas spud 24, is positioned at the top end of a gas fuel riser 65 and is located at the upstream end 16 and introduces fuel into the burner tube 12. Fresh or ambient air is introduced into a primary air chamber 26 through an adjustable damper 28 to mix with the fuel at the upstream end 16 of the burner tube 12 and pass upwardly through the venturi portion 19. Combustion of the fuel and fresh air occurs downstream of the burner tip 20.

A plurality of air ports 30 (FIGS. 2 and 3) originate in a secondary air chamber 32 and pass through the furnace floor 14 into the furnace. Fresh or ambient air enters the secondary air chamber 32 through adjustable dampers 34 and passes through the staged air ports 30 into the furnace to provide secondary or staged combustion, as described in U.S. Pat. No. 4,629,413, which is hereby incorporated herein by reference.

Unmixed low temperature fresh or ambient air, having entered the secondary air chamber 32 through the dampers 34, and having passed through the air ports 30 into the furnace, is also drawn through a passageway 76 into a primary air chamber 26 by the inspirating effect of the fuel passing through the venturi portion 19. The passageway 76 is shown as a metallic FGR duct.

With reference to FIGS. 1–4, a wall 60 encircles the burner tip 20 mounted on the downstream end 18 of the burner tube 12 to provide a barrier between a base of a flame downstream of the burner tip 20 and both the second opening 76 in the furnace and the at least one air port 30.

In one embodiment of the present invention, the wall 60 is perforation-free to prevent flow of flue gas and air therethrough. In another embodiment of the instant invention, the wall 60 has a plurality of wall openings 61 spaced therearound. In the embodiment shown, the openings 61 are rectangular in shape, and are located at the base of the wall 60 and spaced around the wall. The advantage achieved by the use of the openings 61 lies in their alignment, which is optimized to reduce the amount of oxygen from the staged air ports that reaches the flame, reducing the level of interaction of oxygen with the flame. As may be appreciated by one skilled in the art, when aligned in this manner, each wall opening is aligned so as to maximize the flow path from the air ports to the flame. However flue gas is permitted to advantageously enter the flame, enabling a reduction in $NO_x$ emission levels.

In accordance with a preferred embodiment of the present invention, each one of the air ports 30 is positioned between adjacent wall openings 61 to minimize the amount of oxygen flowing from the air ports 30 through the wall openings 61 to the base of the flame.

Sight and lighting port 50 provides access to the interior of burner 10 for a lighting element (not shown).

Flue gas containing, for example, about 0 to about 15% $O_2$ is drawn through passageway 76, with about 5 to about 15% $O_2$ preferred, about 2 to about 10% $O_2$ more preferred and about 2 to about 5% $O_2$ particularly preferred, by the inspirating effect of fuel passing through venturi portion 19 of burner tube 12. In this manner, the primary air and flue gas are mixed in primary air chamber 26, which is prior to the zone of combustion. Therefore, the amount of inert material mixed with the fuel is raised, thereby reducing the flame temperature and, as a result, reducing $NO_x$ emissions. This is in contrast to a liquid fuel burner, such as that of U.S. Pat. No. 2,813,578, in which the combustion air is mixed with the fuel at the zone of combustion, rather than prior to the zone of combustion.

Closing or partially closing damper 28 restricts the amount of fresh air that can be drawn into the primary air chamber 26 and thereby provides the vacuum necessary to draw flue gas from the furnace floor.

A mixture of from about 20% to about 80% flue gas and from about 20% to about 80% ambient air should be drawn through passageway 76. It is particularly preferred that a mixture of about 50% flue gas and about 50% ambient air be employed. The desired proportions of flue gas and ambient air may be achieved by proper placement and/or design of the passageway 76 in relation to the air ports 30. That is, the geometry of the air ports, including but not limited to their distance from the burner tube, the number of air ports, and the size of the air ports, may be varied to obtain the desired percentages of flue gas and ambient air.

Optionally, one or more steam injection tubes 15 may be provided so as to be positioned in the direction of flow so as to add to the motive force provided by venturi portion 19 for inducing the flow of fuel, steam and flue gas, air and mixtures thereof into the burner tube 12.

Figure 6:
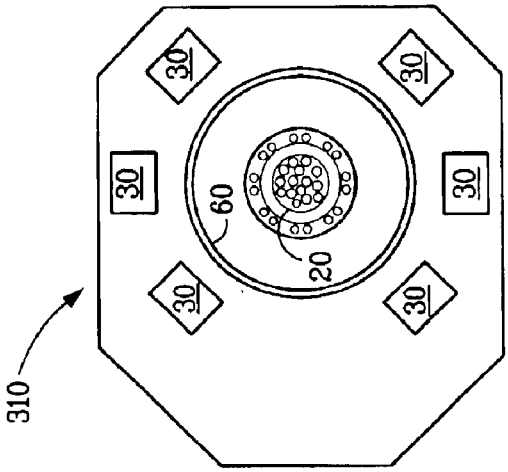
FIG. 6 is a plan view of an embodiment of the present invention employing external FGR.
Figure 5:
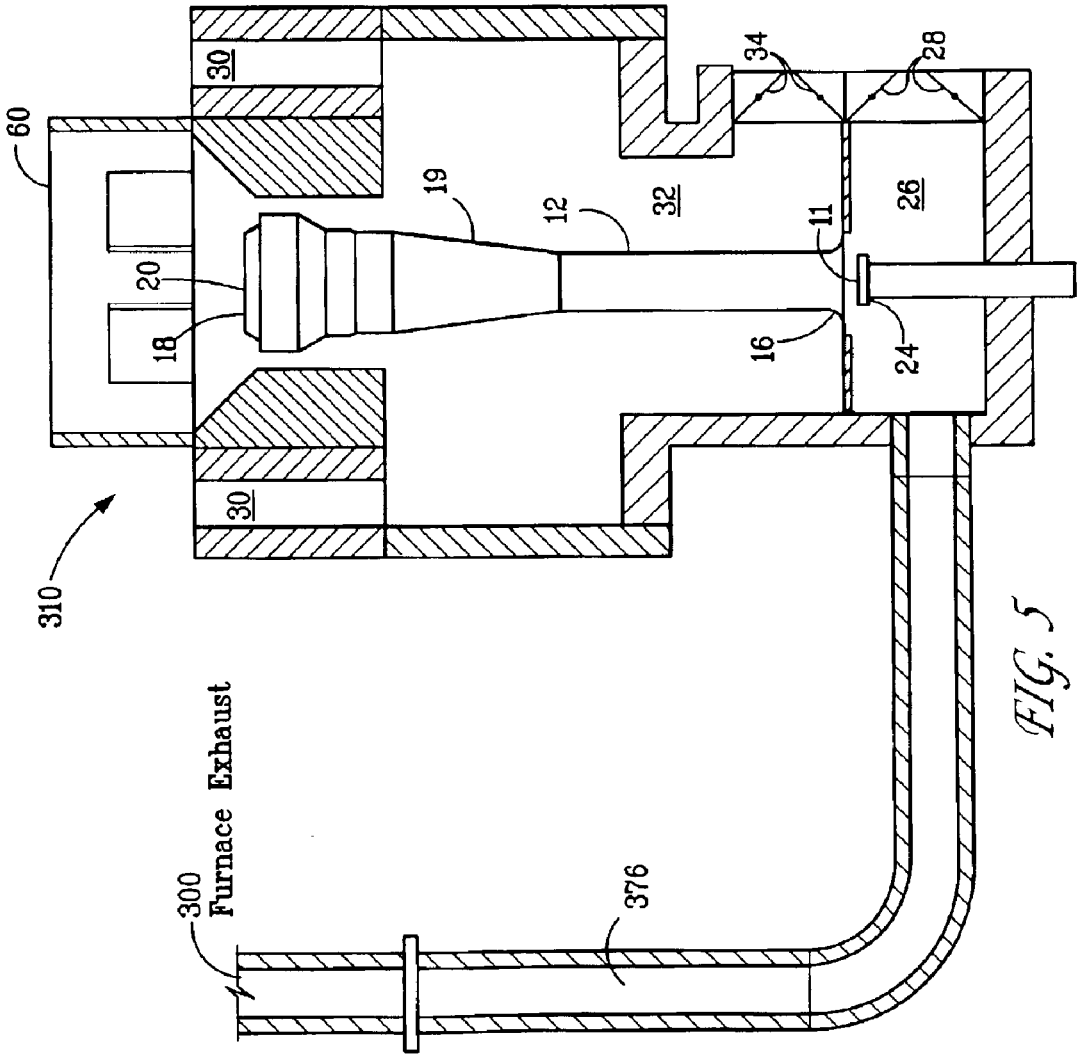
FIG. 5 is an elevation view of an embodiment of the present invention employing external FGR.

Referring to FIGS. 5 and 6, another embodiment of the present invention is illustrated. In this embodiment, the teachings above with respect to the separation wall of the present invention may be applied in connection with a furnace having one or more burners and utilizing an external FGR duct 376 in fluid communication with a furnace exhaust 300. It will be understood by one of skill in the art that several burners 310 may be located within the furnace, all of which may feed furnace exhaust 300 into external FGR duct 376. As may be appreciated, wall 60, encircling the burner tip 20 mounted on the downstream end 18 of the burner tube 12 provides a substantial barrier between a base of a flame at the burner tip 20 and the at least one air port 30.

Figure 7:
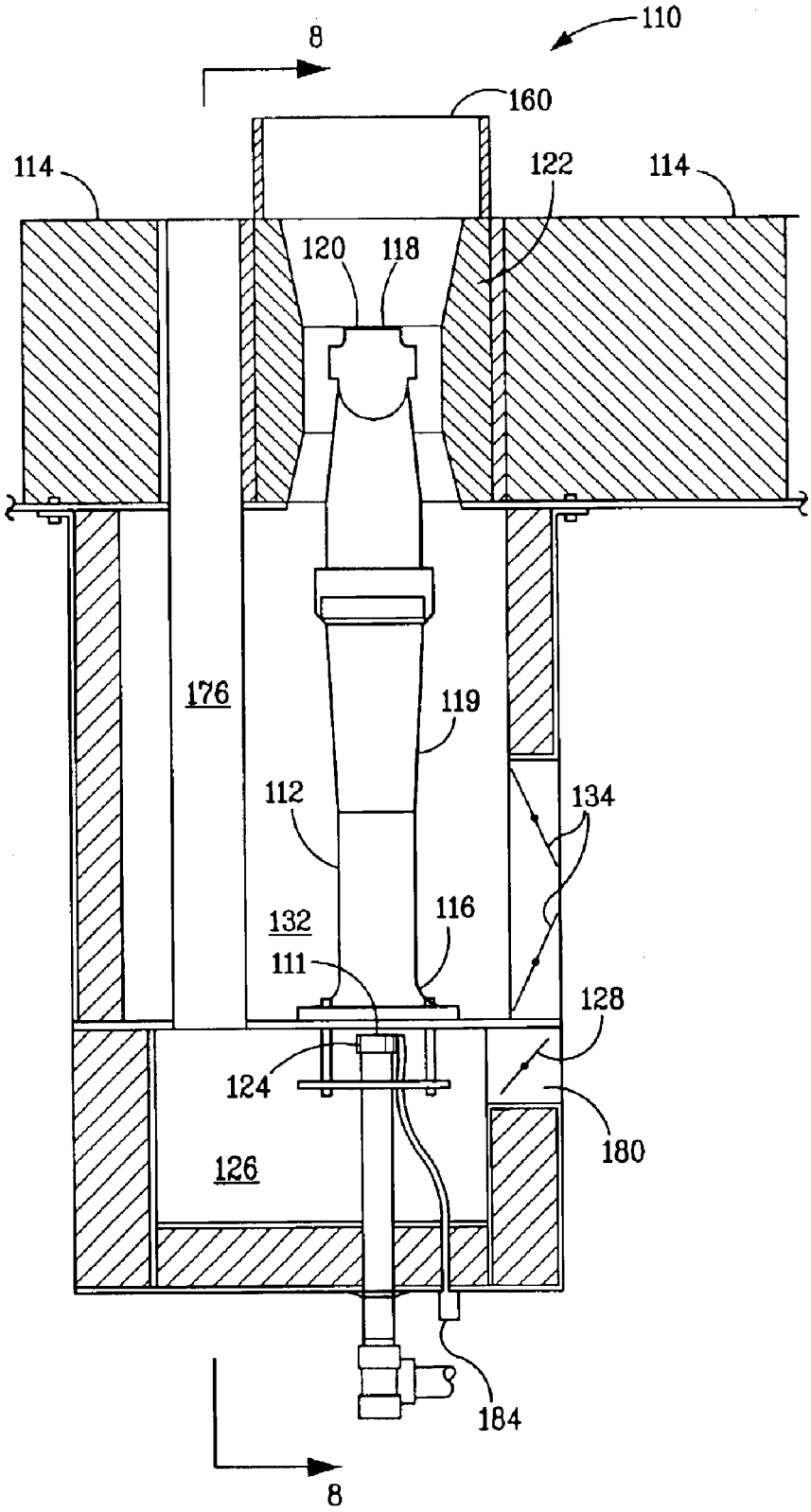
FIG. 7 illustrates an elevation partly in section of an embodiment of a flat-flame burner of the present invention.
Figure 8:
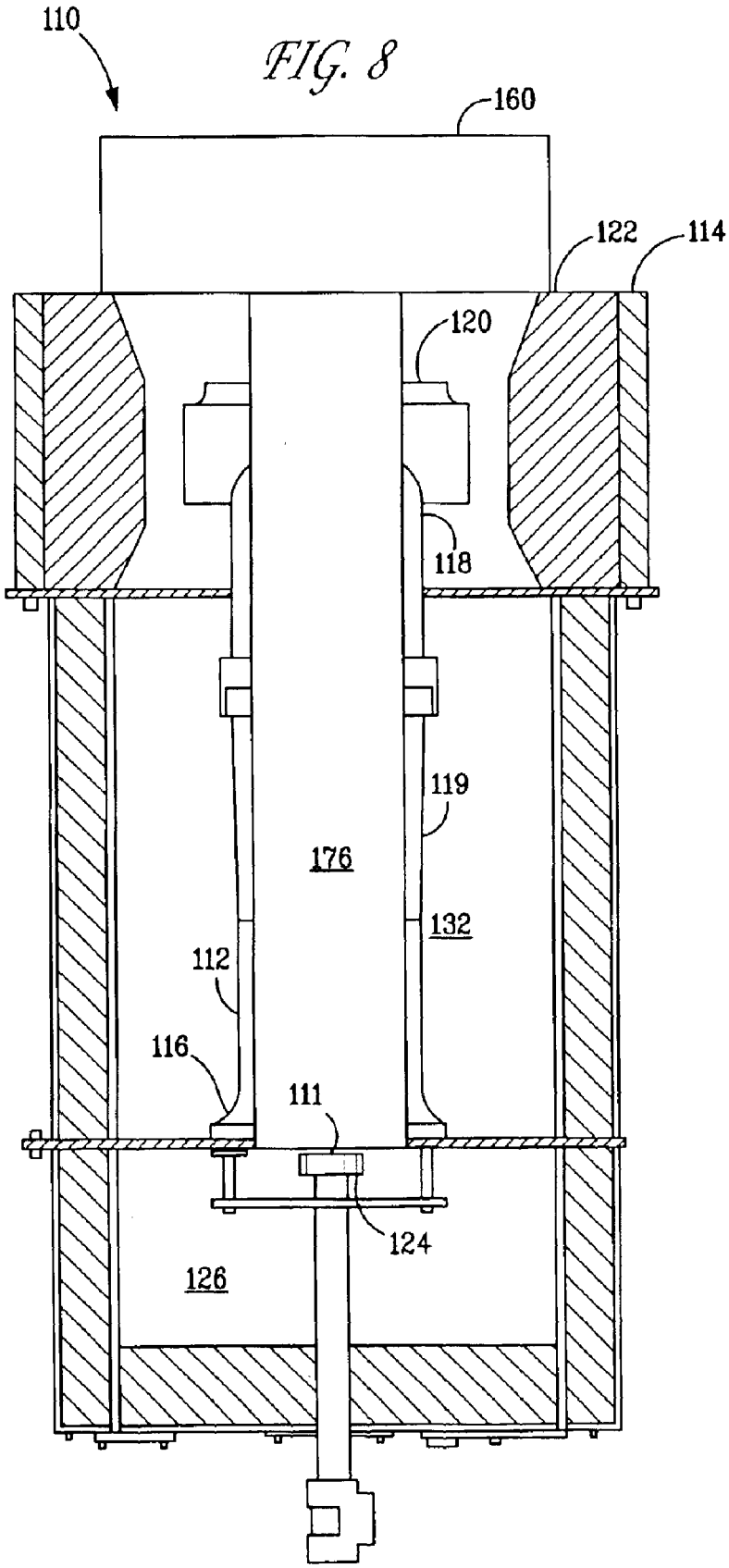
FIG. 8 is an elevation partly in section of the embodiment of a flat-flame burner of FIG. 7 taken along line 8—8 of FIG. 7.

Benefits similar to those described above achieved through the use of the separation wall of the present invention can also be achieved in flat-flame burners, as will now be described by reference to FIGS. 7 and 8.

A burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by a peripheral tile 122. A fuel orifice 111, which may be located in gas spud 124 is located at upstream end 116 and introduces fuel into burner tube 112. Fresh or ambient air may be introduced into primary air chamber 126 to mix with the fuel at upstream end 116 of burner tube 112. Combustion of the fuel and fresh air occurs downstream of burner tip 120. Fresh secondary air enters secondary chamber 132 through dampers 134.

In order to recirculate flue gas from the furnace to the primary air chamber, a flue gas recirculation passageway 176 is formed in furnace floor 114 and extends to primary air chamber 126, so that flue gas is mixed with fresh air drawn into the primary air chamber from opening 180 through dampers 128. Flue gas containing, for example, 0 to about 15% $O_2$ is drawn through passageway 176 by the inspirating effect of fuel passing through venturi portion 119 of burner tube 112. Primary air and flue gas are mixed in primary air chamber 126, which is prior to the zone of combustion.

A small gap exists between the burner tip 120 and the burner tile 122. By keeping this gap small, the bulk of the secondary staged air is forced to enter the furnace through staged air ports (not shown) located some distance from the primary combustion zone, which is located immediately on the furnace side of the burner tip 120.

In operation, fuel orifice 111, which may be located within gas spud 124 discharges fuel into burner tube 112, where it mixes with primary air, recirculated flue-gas or mixtures thereof. The mixture of fuel and recirculated flue-gas, primary air or mixtures thereof then discharges from burner tip 120. The mixture in the venturi portion 119 of burner tube 112 is maintained below the fuel-rich flammability limit; i.e. there is insufficient air in the venturi to support combustion. Staged, secondary air is added to provide the remainder of the air required for combustion. The majority of the staged air is added a finite distance away from the burner tip 120 through staged air ports (not shown). However, a portion of the staged, secondary air passes between the burner tip 120 and the peripheral tile 122 and is immediately available for combustion.

As with previous embodiments, a wall 160 peripherally surrounds the burner tip 120 mounted on the downstream end 118 of the burner tube 112 to provide a substantial barrier between a base of a flame downstream of the burner tip 120 and both the second opening 176 in the furnace and the at least one air port (not shown). The wall 160 reduces the amount of oxygen flowing into the base of the flame.

Optionally, one or more steam injection tubes 184 may be provided so as to be positioned in the direction of flow so as to add to the motive force provided by venturi portion 119 for inducing the flow of fuel, steam and flue gas, air and mixtures thereof into the burner tube 112.

EXAMPLES

Example 1

To demonstrate the benefits of the present invention, a pre-mix burner employing flue gas recirculation, of the type described in U.S. Pat. No. 5,092,761, without a wall encircling the burner tip to provide a barrier between the base of the flame and both the flue gas recirculation duct and the secondary air openings, of the present invention, was operated at a firing rate of 5.8 million BTU/hr., using a fuel gas comprised of 30% $H_2$/70% natural gas. The burner yielded $NO_x$ emissions of 49 ppm.

Example 2

A wall encircling the burner tip to provide a barrier between the base of the flame and both the flue gas recirculation duct opening and the secondary air openings of the present invention, was installed in the premix burner of Example 1. The burner was operated at a firing rate of 6.135 million BTU/hr., with a fuel gas comprised of 30% $H_2$/70% natural gas. The $NO_x$ emissions were observed to be 46.11 ppm.

Computational fluid dynamics modeling and, as indicated above, actual tests on a commercial unit have shown that the existing design, without a wall peripherally surrounding the burner tip, possesses a high concentration oxygen zone in the furnace above the FGR duct(s). It is believed that a part of this oxygen flows into the base of the flame and may be responsible for higher $NO_x$ production as a result of the large amount of oxygen interacting with the flame base. While it is believed that such co-current flow causes good mixing and high combustion rate, higher temperatures and higher levels of $NO_x$ emissions likely result from this effect. In an effort to solve this problem, it has been discovered that the use of a wall, in accordance with the present invention, between the flame and the oxygen recirculation zone can serve to greatly reduce the interaction between the two.

Although the burners of this invention have been described in connection with floor-fired hydrocarbon cracking furnaces, they may also be used on the side walls of such furnaces or in furnaces for carrying out other reactions or functions.

Thus, it can be seen that, by use of this invention, NOx emissions may be reduced in a burner without the use of fans or special burners. The flue gas recirculation system of the invention can also easily be retrofitted to existing burners.

In addition to the use of flue gas as a diluent, another technique to achieve lower flame temperature through dilution is through the use of steam injection. Steam can be injected in the primary air or the secondary air chamber. Preferably, steam may be injected upstream of the venturi.

It will also be understood that the present invention described herein also has utility in raw gas burners having a pre-mix burner configuration wherein flue gas alone is mixed with fuel gas at the entrance to the burner tube. In fact, it has been found that the pre-mix, staged-air burners of the type described in detail herein can be operated with the primary air damper doors closed and only flue gas drawn into the primary chamber, with very satisfactory results.

Although the invention has been described with reference to particular means, materials and embodiments, it is to be understood that the invention is not limited to the particulars disclosed and extends to all equivalents within the scope of the claims.

What is claimed is:

1. A staged-air burner for use in a furnace having a furnace floor, said staged-air burner being located adjacent a first flame opening in the furnace floor, said staged-air burner comprising:

(a) a burner tube including (i) a downstream end, (ii) an upstream end for receiving fuel and air, flue gas or mixtures thereof from a primary air chamber, and (iii) a bumer tip mounted on the downstream end of said burner tube and directed to the first flame opening in the furnace, so that combustion of the fuel takes place downstream of said burner tip;

(b) a secondary air chamber for supplying a second portion of combustion air, said secondary air chamber in fluid communication with at least one air port; and (c) a wall perpendicularly disposed in relation to the furnace floor and extending into the furnace, said wall peripherally surrounding said burner tip to provide a substantial barrier between a base of a flame at said burner tip and said at least one air port.

2. The burner according to claim 1, wherein the burner is a pre-mix burner.

3. The burner according to claim 1, wherein the burner is a flat-flame burner.

4. The burner according to claim 1, wherein said burner further comprises an external FGR duct.

5. The burner according to claim 1, further comprising:

(a) at least one passageway having a first end at a second opening in the furnace and a second end opening into said primary air chamber, said primary air chamber being in fluid communication with the upstream end of said burner tube; and (b) means for drawing flue gas from said furnace, through said passageway and said primary air chamber in response to an inspirating effect of uncombusted fuel flowing through said burner tube from its upstream end towards its downstream end;

whereby said wall peripherally surrounding said burner tip also provides a substantial barrier between the base of the flame at said burner tip and said second opening in said furnace.

6. The burner according to claim 5, further comprising a fuel orifice located adjacent the upstream end of said burner tube for introducing fuel into said burner tube, said fuel orifice being mounted on a gas riser.

7. The burner according to claim 6 wherein said fuel orifice is located within a gas spud.

8. The burner according to claim 5, wherein said means for drawing flue gas from said furnace comprises a venturi portion in said burner tube.

9. The burner according to claim 8, wherein said wall operates to reduce the amount of oxygen flowing into the base of the flame.

10. The burner according to claim 1, wherein said wall operates to reduce the amount of oxygen flowing into the base of the flame.

11. The burner according to claim 1, further comprising a first adjustable damper opening between said passageway and a source of air.

12. The burner according to claim 11, wherein said first adjustable damper opening is effective to restrict the amount of air entering into said primary air chamber and thereby providing a vacuum to draw flue gas from the furnace.

13. The burner according to claim 11, further comprising a second adjustable damper opening into said secondary air chamber to restrict the amount of air entering into said secondary air chamber.

14. The burner according to claim 13, wherein said secondary air chamber is in fluid communication with a plurality of said air ports.

15. The burner according to claim 1, wherein said secondary air chamber is in fluid communication with a plurality of said air ports.

16. The burner according to claim 5, wherein said wall is perforation-free to prevent flow of flue gas and air therethrough.

17. The burner according to claim 15, wherein said wall has a plurality of wall openings.

18. The burner according to claim 1, wherein said wall has a plurality of wall openings.

19. The burner according to claim 17, wherein said wall openings are at the base of said wall.

20. The burner according to claim 17, wherein each one of said air ports is positioned between adjacent wall openings to minimize the amount of oxygen flowing from said air ports and through said wall openings to the base of the flame.

21. The premix burner according to claim 1, further comprising at least one steam injection tube.

22. A method for use in a staged-air burner for the combustion of fuel, the burner being located adjacent a first opening in a furnace, the furnace having a furnace floor, and including a primary air chamber for supplying a first portion of combustion air, a burner tube including a downstream end, an upstream end for receiving fuel and air, flue gas or mixtures thereof, a burner tip mounted on the downstream end of the burner tube adjacent the first opening in the furnace, so that combustion of the fuel takes place at the downstream end of the burner tip and a secondary air chamber for supplying a second portion of combustion air, the secondary air chamber in fluid communication with at least one air port, the method comprising installing a wall perpendicularly disposed in relation to the furnace floor and extending into the furnace, the wall peripherally surrounding the burner tip mounted on the upstream end of the burner tube and substantially blocking the flow of secondary air by providing a substantial barrier between a base of a flame at the burner tip and the at least one air port.

23. The method according to claim 22, wherein the burner is a pre-mix burner.

24. The method according to claim 22, wherein the burner is a flat-flame burner.

25. The method according to claim 22, wherein the burner further comprises an external FGR duct.

26. The method according to claim 22, wherein the wall has a plurality of wall openings therearound.

27. The method according to claim 22, further comprising injecting steam through at least one steam injection tube.

* * * * *